US009945154B2

(12) United States Patent
Delgado et al.

(10) Patent No.: US 9,945,154 B2
(45) Date of Patent: Apr. 17, 2018

(54) SLIDING KEY

(71) Applicant: Ford Global Technologies, LLC, Dearborn, MI (US)

(72) Inventors: Gerardo Brigido Delgado, Livonia, MI (US); Jorge Alejandro Rodriguez Melendez, Metepec (MX); Mark Vargas Morelli Luna, Delegacion Xochimilco (MX); Alan Rodrigo Saucedo Osorno, Iztapalapa (MX)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 70 days.

(21) Appl. No.: 15/197,009

(22) Filed: Jun. 29, 2016

(65) Prior Publication Data

US 2018/0002951 A1 Jan. 4, 2018

(51) Int. Cl.
*E05B 19/04* (2006.01)
*E05B 19/00* (2006.01)

(52) U.S. Cl.
CPC ..... *E05B 19/046* (2013.01); *E05B 19/0082* (2013.01)

(58) Field of Classification Search
CPC .. E05B 19/046; E05B 19/0082; E05B 19/043; Y10T 70/8676; Y10T 70/8757; Y10T 70/7876; Y10T 70/7814; Y10T 70/7819; Y10T 70/7825
USPC ..... 70/395, 397–399, 408, 456 R, 459, 460; 206/38.1, 37.1–37.8
See application file for complete search history.

(56) References Cited

U.S. PATENT DOCUMENTS

| | | | | |
|---|---|---|---|---|
| 2,008,398 | A | 7/1935 | Mangan | |
| 2,897,667 | A | 8/1959 | Taylor | |
| 4,354,368 | A | 10/1982 | Toyoda | |
| 4,524,594 | A | 6/1985 | Bascou | |
| 4,628,717 | A * | 12/1986 | Blum | A45C 11/321 30/162 |
| 4,805,304 | A | 2/1989 | Knoop | |
| 4,941,569 | A | 7/1990 | Lindmayer et al. | |
| 5,232,086 | A | 8/1993 | Montanari | |
| 5,355,702 | A * | 10/1994 | Escribens | E05B 19/18 70/395 |
| 5,460,022 | A * | 10/1995 | Parsons | A45C 11/321 206/37.1 |

(Continued)

FOREIGN PATENT DOCUMENTS

| | | | |
|---|---|---|---|
| CN | 201991317 | U | 9/2011 |
| WO | WO 2006/090670 | A1 | 8/2006 |
| WO | WO 2007/088765 | A1 | 8/2007 |

OTHER PUBLICATIONS

Honda/Acura Dead Key Fob Help, [Online] Retrieved from http://dashboardsymbols.com/2012/04/honda-acura-dead-fob/, (2 Pages).

(Continued)

*Primary Examiner* — Lloyd A Gall
(74) *Attorney, Agent, or Firm* — James P. Muraff; Neal, Gerber & Eisenberg LLP

(57) ABSTRACT

A key assembly includes a key: defining a retaining recess, being slideably received in a key rail, and having a key pin; a slider: with extensions, defining a pin void receiving the key pin, and being configured to both pivot and translate with respect to the key pin; the extensions slideably received in a curved slider rail.

20 Claims, 6 Drawing Sheets

(56) References Cited

U.S. PATENT DOCUMENTS

| | | | | |
|---|---|---|---|---|
| 5,487,291 | A * | 1/1996 | Voigt | A45C 11/32 206/37.2 |
| 6,474,123 | B1 * | 11/2002 | Kito | E05L 319/046 206/37.2 |
| 7,634,932 | B2 | 12/2009 | Cadiz et al. | |
| 8,028,420 | B2 | 10/2011 | Gui et al. | |
| 8,146,736 | B2 * | 4/2012 | Downes | A45C 11/328 206/37.2 |
| 8,225,696 | B2 * | 7/2012 | Downes | A45C 11/328 29/402.06 |
| 8,341,989 | B1 * | 1/2013 | Hamblin | A45C 11/328 70/408 |
| 8,365,560 | B2 * | 2/2013 | Domit | E05B 11/005 70/456 R |
| 8,485,007 | B2 | 7/2013 | Downes | |
| 2006/0144106 | A1 | 7/2006 | Beresnitzky | |
| 2008/0072638 | A1 * | 3/2008 | Rooker | A45C 11/328 70/456 R |
| 2008/0087062 | A1 * | 4/2008 | Chen | A45C 11/32 70/456 R |
| 2008/0196462 | A1 | 8/2008 | Beresnitzky | |
| 2010/0126242 | A1 * | 5/2010 | Perlmutter | A44B 15/007 70/456 R |

OTHER PUBLICATIONS

Search Report dated Nov. 21, 2017, for GB Patent Application No. 1710118.9 (3 Pages).

* cited by examiner

SLIDING KEY

TECHNICAL FIELD

This disclosure relates to a sliding mechanical key. The key fit into and unlock a lock, such as a vehicle door lock or an ignition lock.

BACKGROUND

US Publication No. 2008/0196462 to Beresnitzky discloses a key case including a housing within which there is a plurality of rotationally mounted key holders. Each key holder is connected to an individual key. A plurality of buttons is mounted on the housing. Pressing on a selected button enables a desired key to swing out of the housing and move into an outwardly projecting position wherein it can be used to unlock a lock. In an alternative embodiment of the invention a selector assembly which is slideably mounted on the housing supports an operating button which facilitates pressing the desired button to select a key.

U.S. Pat. No. 8,485,007 to Downes discloses an organizing device including housing, cover, and sliding mechanism. The housing includes a cavity, at least one open end and at least one sliding mechanism opening extending in the longitudinal direction along the housing for receiving and retaining at least part of the sliding mechanism within the housing. The cover is removeably attached over the open end of the housing. Sliding mechanism includes an actuation portion or thumb actuator and mounting portion for mounting a key or other user device. The mounting portion of the sliding mechanism is positioned inside cavity of the housing and the actuation portion of the sliding mechanism extends though the sliding mechanism opening in the housing. In one implementation, the mounting mechanism may be permanently or removeably fixed to the user device. In the case of a key, the mounting mechanism may be mounted to the key blade to form the modified key. The sliding mechanism is movable longitudinally along the housing to retract and extend the user device in and out of one end of the housing.

SUMMARY

One embodiment of a key assembly includes a key defining a retaining recess, being slideably received in a key rail, and having a key pin; a slider with extensions, defining a pin void receiving the key pin, and being configured to both pivot and translate with respect to the key pin; the extensions slideably received in a curved slider rail; a retainer configured to occupy the retaining recess to hold the key in a retracted position, the retainer including a retaining ball biased by a spring received in a retainer slot intersecting the key rail; wherein the retaining recess of the key includes a first retaining recess and a second retaining recess, the first retaining recess is positioned and configured to interface with the retainer to hold the key in a retracted position, the second retaining recess is positioned and configured to interface with the same retainer to hold the key in an extended position; wherein the extensions include at least two longitudinally displaced sections, each configured to fully occupy a height dimension of the slider rail, wherein the longitudinal direction is defined to be in a sliding direction of the key within the key rail; wherein the pin void is a generally rectangular closed void and the key pin is sized and configured to fully occupy a width dimension of the pin void, the width dimension of the pin void being parallel to the longitudinal direction.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
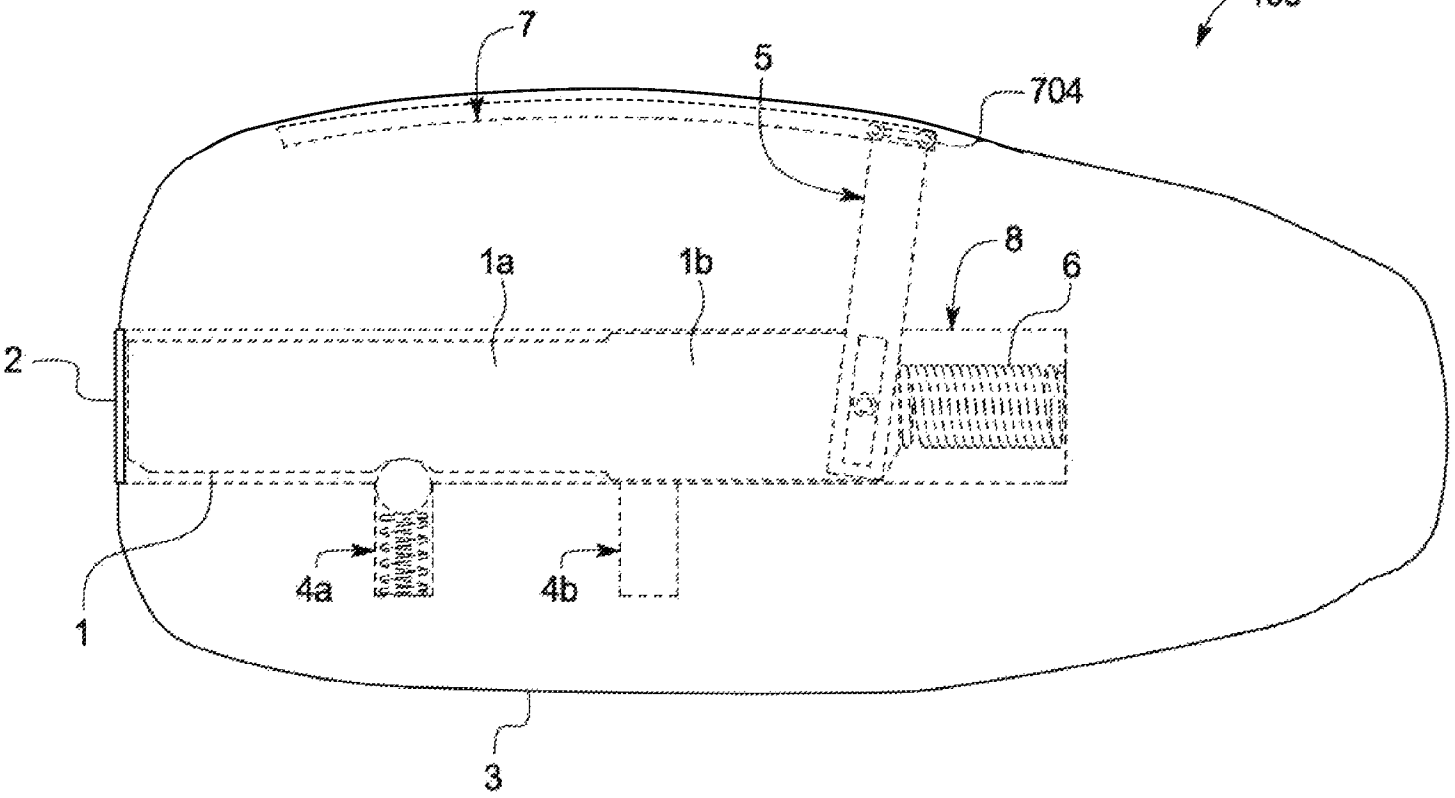
FIG. 1 is a side view of a key assembly with a key in a retracted position.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated. It should be appreciated that when the claims include dimensional relationships (e.g., element A "fully occupies" element B), such dimensional relationships include and contemplate manufacturing tolerances such that element A may not precisely full occupy element B.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or" as one option and "either or" as another option.

FIG. 1 generally shows and illustrates a key assembly 100. including a key 1, a door 2, a housing 3, a key retainer 4 (it should be appreciated that the key retainer 4 is shown in two different locations, a first key retainer location 4*a* and a second key retainer location 4*b*; disclosure related to key retainer 4 applies both of the first key retainer location 4*a* and the second key retainer location 4*b*, as discussed below), a slider 5, a spring 6, a slider rail 7, and a key rail 8. The key assembly 100 generally operates in the following manner: A user motivates the slider 5 along the slider rail 7. The slider 5 applies force against the key 1 until the key 1 is able to overcome the key retainer 4.

The spring 6 is optional. If the key assembly 100 includes the spring 6, then the spring 6 pushes the key 1 along the key rail 8 into the door 2. The key 1 opens the door 2. The spring 6 continues to push the key 1 until the key 1 is fully extended. If the key assembly does not include the spring 6, then the user continues to motivate the slider 5 along the slider rail 7 until the key 1 is in a fully extended position.

Once the key 1 is in the fully extended position, the retainer 4 prevents the key 1 from inadvertently retracting.

Figure 2:
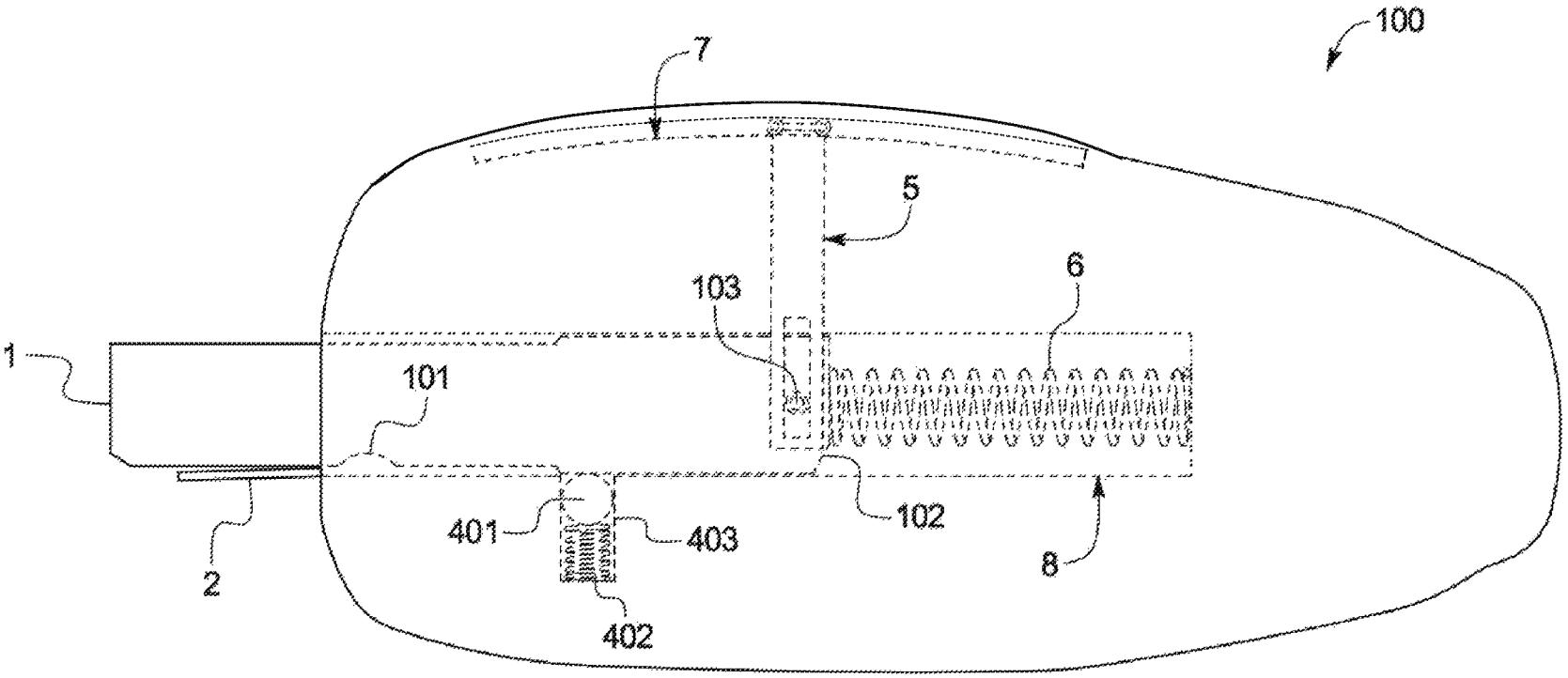
FIG. 2 is a side view of the key assembly with the key being in an intermediate position (i.e., partially retracted and partially extended).

The key 1 can be cut or uncut. When the key 1 is cut, the key 1 is configured to open or access a lock. The key 1 has a thin portion 1*a* and a thick portion 1*b*. As shown in FIG. 2, the key 1 defines a first retaining recess 101, a second retaining recess 102, and includes a key pin 103. FIG. 1 shows the thin portion 1*a* defining the first retaining recess 101. In various embodiments, the thick portion 1*b* defines the first retaining recess 101. They key 1 may include multiple first retaining recesses 101, including first retaining recesses 101 defined along a top or side of the key 1. As shown in FIG. 2, the first retaining recesses 101 is configured to receive a retaining ball 401 of the key retainer 4. If the key includes multiple first retaining recesses 101, then each first retaining recess 101 may be configured to receive a similar retaining ball 401.

Figure 3:
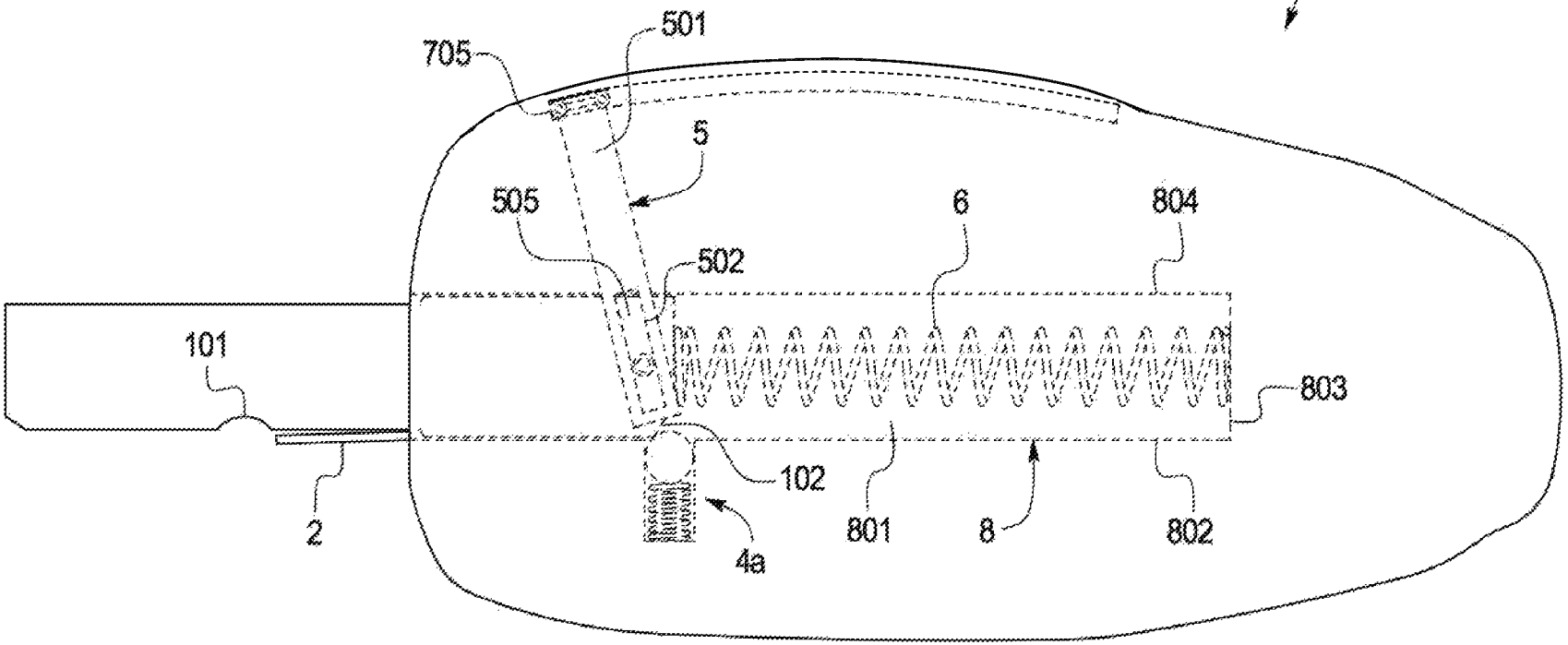
FIG. 3 is a side view of the key assembly the key being fully extended.

The key 1 further defines a second retaining recess 102. FIG. 3 shows the second retaining recess 102 being a chamfer along a bottom of the key 1. In various embodiments, the second retaining recess 102 is dome-shaped (similar to the first retaining recess 101) and is defined along a bottom surface of the key closer to the first retaining recess 101 (i.e., near, but longitudinally spaced from, the right surface of the key 1 contacting the spring 6). The second retaining recess 102 is also configured to receive the retaining ball 401 of the key retainer 4.

The key retainer 4 is configured to arrest longitudinal translation of the key 1 when the key 1 occupies a certain longitudinal position along the key rail 8. As shown in FIG. 2, the key retainer 4 includes a retaining ball 401 and a spring 402, both of which are configured to occupy a retainer slot 403. The spring 402 is under compression and therefore biases the retaining ball 401 upwards (i.e., out of the retainer slot 403 and toward the key 1). According to various embodiments, the retaining ball 401 is attached to the spring 402 such that the retaining ball 401 may rotate, move upwards and downward in the retainer slot 403, but not roll into the key rail 8.

FIG. 1 shows the key 1 being in a longitudinally retracted (i.e., retracted) position. Here, the spring 402 has biased the retaining ball 401 into the first retaining recess 101. Force exerted by spring 6 against the key 1 and/or light force exerted by slider 5 against the key 1 are insufficient for the key 1 to overcome the biasing force of the spring 402 and push the retaining ball 401 back into the retainer slot 403. Upon sufficient force, the curved surfaces defining the first retaining recess 101 push the retaining ball 401 back into the retainer slot 403. The key 1 may now longitudinally translate to occupy an intermediate position. One intermediate position is shown in FIG. 2.

When the key 1 reaches its fully extended position of FIG. 3, the second retaining recess 102 lines up with the retainer slot 403. The spring 402 biases the retaining ball 401 upward and into contact with the surfaces of the key 1 defining the second retaining recess 102. If the second retaining recess 102 is dome-shaped (similar to the first retaining recess 101), then the second retaining recess 102 opposes longitudinal movement of the key 1 in both of the longitudinally forward and backward directions. If the second retaining recess 102 is defined by a slanted surface, as shown in FIG. 3, then the second retaining recess 102 only opposes longitudinal movement of the key 1 in the longitudinally backward direction (i.e., only opposes retraction of the key 1). Upon sufficient user-applied force, the surfaces defining the second retaining recess 102 push the retaining ball 401 back into the retaining slot 403.

It should thus be appreciated that the first retaining recess 101, the second retaining recess 102, and the retainer slot 403 are arranged and dimensioned such that the retaining ball 401 occupies the first retaining recess 101 when the key 1 is fully (or substantially fully) retracted and the second retaining recess 102 when the key is fully (or substantially fully) extended.

Some keys 1 may be too short or long to accommodate such an arrangement. In these cases, a second retainer 4*b* may be provided such that the first retainer 4*a* interacts with the first retaining recess 101 when the key 1 is longitudinally retracted and the second retainer 4*b* interacts with the second retaining recess 102 when the key 1 is longitudinally extended. If the key 1 defines multiple first and second retaining recesses 101 and 102, then the key 1 may include multiple retainers 4 (e.g., one retainer 4 per pair of recesses 101 and 102 or one retainer 4 for each recess 101 and 102). In one embodiment, the key 1 defines first and second retaining recesses 101 and 102 on the top surface of the key 1 in addition to the bottom surface of the key 1.

Figure 4:
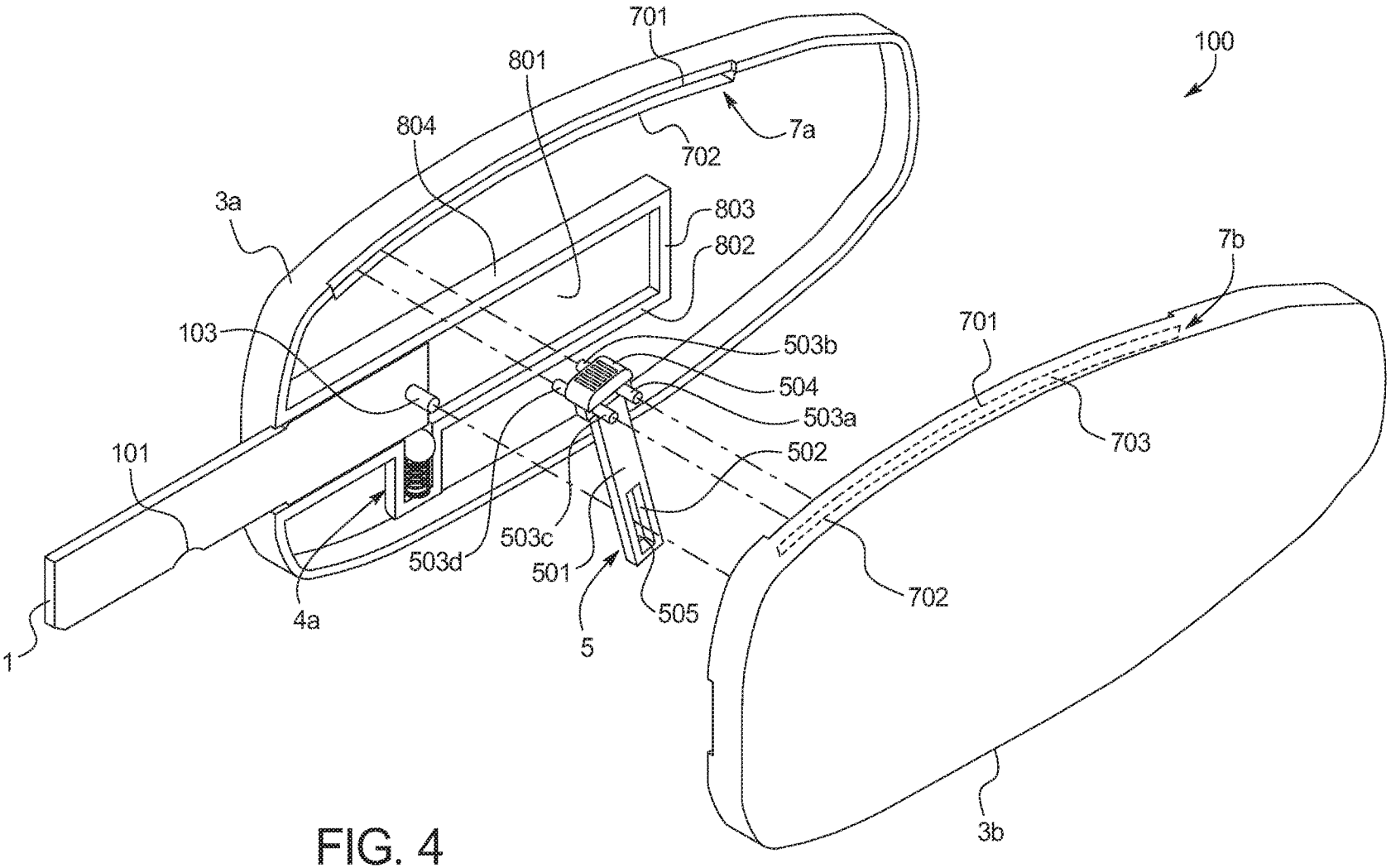
FIG. 4 is an exploded view of the key assembly.

As shown in FIG. 4, the housing 3 includes a first housing 3*a* and a second housing 3*b* joined together. In some embodiments, only the first housing 3*a* defines the key rail 8. In other embodiments, the first housing 3*a* and the second housing 3*b* cooperate to define the key rail 8.

The door 2 is attached to the housing 3. The door 2 is optional and configured to prevent ingress of fluid or debris into the key rail 8. In some embodiments, the door 2 rotates as shown in FIGS. 1 and 2. In these embodiments, the door 2 may include a spring (not shown) that biases the door 2 to the closed position of FIG. 1. In some embodiments, the door 2 includes lips configured and biased to compress together when the key 1 is retracted. In these embodiments, the key 1 extends through and pushes apart the lips 2 when the key 1 longitudinally extends.

The slider 5 is configured to transfer force to the key 1 via the key pin 103. As shown in FIG. 4, the slider 5 includes an intermediate slider 501 with inner surfaces 502 defining a pin void 505, and a lateral slider 504 with rail extensions 503.

Figure 5:
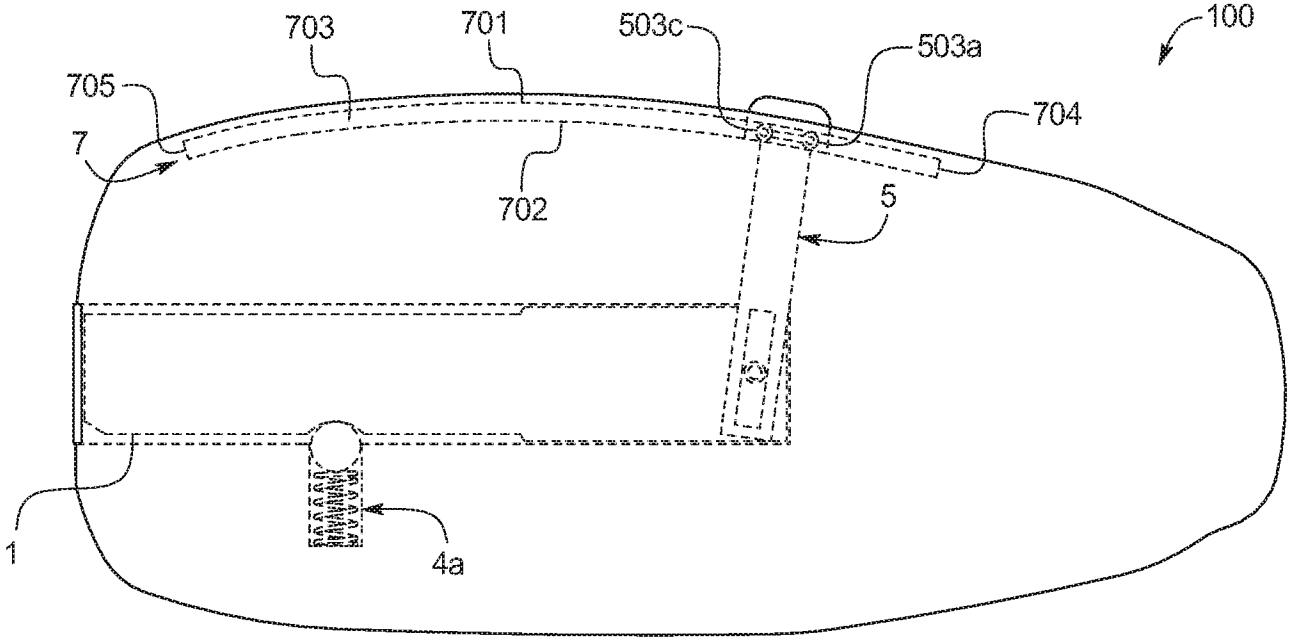
FIG. 5 is a side view of the key assembly illustrating details of a slider rail.
Figure 6:
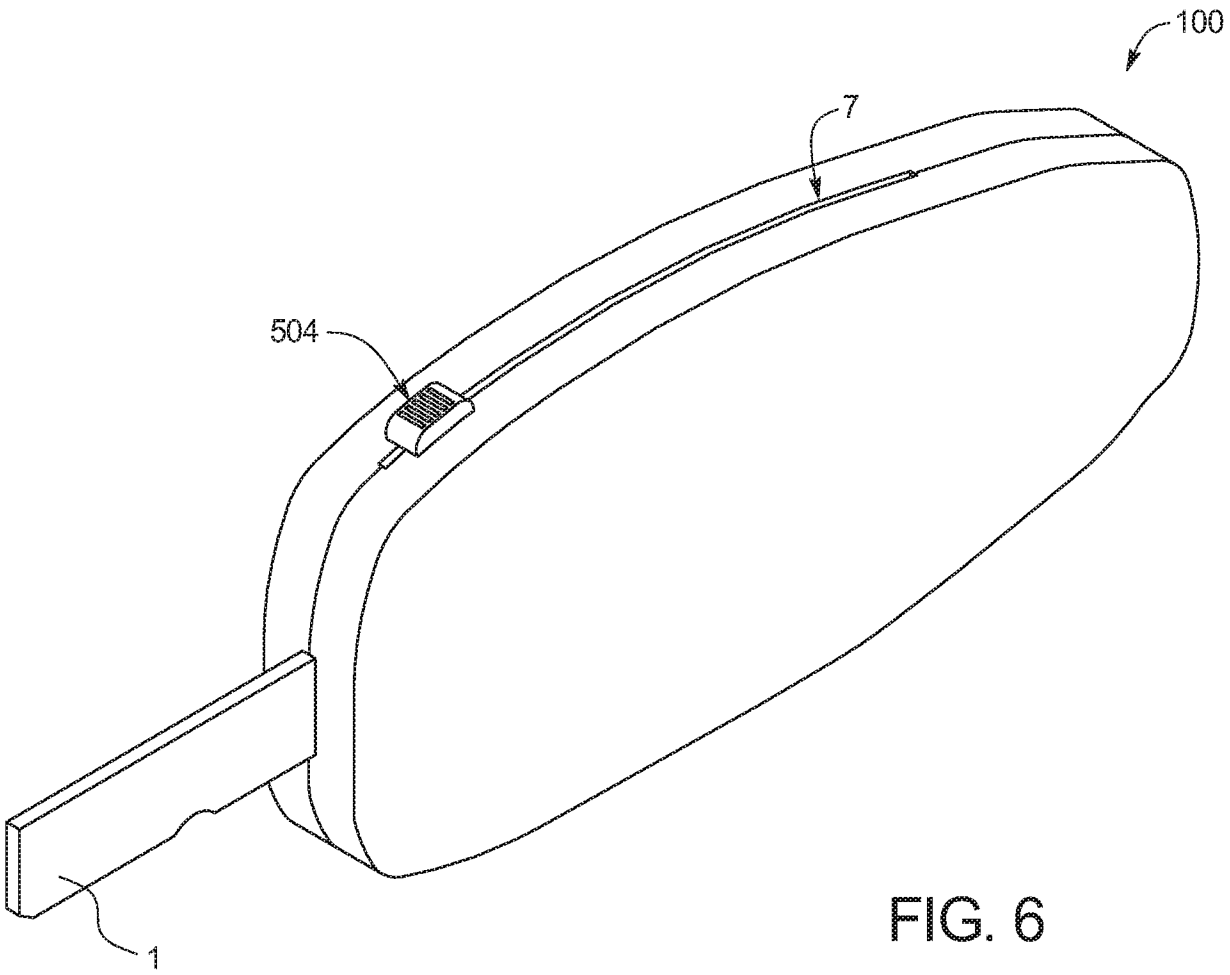
FIG. 6 is a perspective view of the key assembly.

As shown in FIGS. 4, 5 and 6, the lateral slider 504 protrudes from the housing 3. A top surface of the lateral slider 504 includes a finger grip (not labeled). As stated above, the lateral slider 504 includes rail extensions 503. The rail extensions 503 are generally cylindrical and are configured to be slideably received in the slider rail 7. The rail extensions include first, second, third, and fourth rail extensions 503*a*, 503*b*, 503*c*, and 503*d*. In various embodiments, opposing rail extensions (e.g., 503*a* and 503*b*) are opposing ends of a single, continuous extension bar. In various embodiments, each rail extension 503 is discrete.

As shown in FIG. 4, the rail extensions 503 extend in a direction transverse to the longitudinal axis of the key assembly 100. At least a portion of each rail extension 503 is slideably received within a recess 703 of the slider rail 7. FIG. 5 shows rail extensions 503*c* and 503*a* being slideably received within the recess 703 of the slider rail 7. In various embodiments, the rail extensions 503 have a diameter substantially (substantially as used within this specification means 5%, 3%, 1%, 0.5%, or 0.1%) equal to the thickness (e.g., distance 704 of FIG. 5) of the recess 703. In various embodiments, the extensions 503 are rotatable within the slider 5 similar to the axles of a vehicle. In various embodiments, the rail extensions 503 are cylindrical bearings configured to roll within the recess 703.

As discussed above, the slider 5 includes an inner surface 502 defining the rectangular pin void 505 to accommodate the key pin 103. As shown in FIG. 3, the width of the pin void 505 may be equal or substantially equal to the diameter of the key pin 103. The slider 5 rotates about the key pin 103 via the pin void 505. The slider 5 also vertically translates (i.e., moves up and down) with respect to the key pin 103.

The slider rail 7 is configured to receive the rail extensions 503. The slider rail 7 is defined in the housing 3. As shown in FIG. 4, the slider rail 7 may be separated into a first slider rail section 7*a* and a second slider rail section 7*b*. Each rail section 7 includes an upper surface 701, a lower surface 702, a front surface 705 and a rear surface 704. The surfaces 701, 702, 704, and 705 cooperate to define the recess 703. Features of the slider rail 7 are best shown in FIGS. 4, 5, and 6.

As shown in FIG. 5, the upper surface 701 and the lower surface 702 may be curved such that the recess 703 is arced. The upper surface 701 and the lower surface 702 are spaced apart such that the distance between the upper surface 701 and the lower surface 702 is generally constant along the curve (i.e., the vertical thickness of the recess 703 is constant or substantially constant). In various embodiments, the rear surface 704 is located at a position corresponding to a retracted position of the key 1 (see FIG. 1) and the front surface 705 is located at a position corresponding to an extended position of the key 1 (see FIG. 3). In other embodiments, and as shown in FIG. 5, the front and rear surfaces 705 and 704 are slightly spaced from the extended and retracted positions of the key 1. As shown in FIG. 5, the complete length of the upper surface 701 (in the longitudinal direction) may be spaced from the upper-most surface of the housing 3 (i.e., the external surface of the housing 3 that is closest to the slider rail 7) by a generally constant degree. Also as shown in FIG. 5, the curvature of the complete length of the upper surface 701 (in the longitudinal direction) may match the curvature of the upper-most surface of the housing 3.

As stated above, the spring 6 is optional. When the spring 6 is present, the key 1 may be attached to a first spring seat (not shown) that receives the spring 6. Likewise, the housing 3 may include a second spring seat (not shown) to receive the opposing end of the spring 6 in the key rail 8.

The key rail 8 includes a lower surface 802, a rear surface 803, and an upper surface 804. The surfaces 802, 803, and 804 cooperate to define a key rail recess 801. The key rail recess 801 may have a substantially constant height (i.e., the dimension between lower surface 802 and upper surface 804). The height may be substantially equal to the height of the key 1, thus preventing the key 1 from twisting in the key rail recess 8.

As shown in FIG. 4, the key rail 8 may be exclusively part of the first housing portion 3*a*. In these embodiments, the key rail 8 may fit against an inner surface (not shown) of the second housing portion 3*b*. This renders the lateral thickness of the key rail recess 801 (in the direction parallel to the major axis of the key pin 103) substantially equal to the lateral thickness of the key 1. In other embodiments, the first housing portion 3*a* and the second housing portion 3*b* cooperate to form the key rail 8 (i.e., the second housing portion 3*b* includes a mirror image of the key rail 8). In these embodiments, the lateral thickness of the key rail 8 of each housing portion 3*a* and 3*b* is halved so that when the housing portions 3*a* and 3*b* are combined, the lateral thickness of the key rail 8 substantially equals to the lateral thickness of the key 1.

The general operation of the key assembly 100 will now be described. The key 1 begins in its retracted position shown in FIG. 1. The key retainer 4 holds the key in the retracted position. A user grips the lateral slider 504 and pushes the lateral slider 504 forward. The lateral slider 504 transmits this force, via the intermediate slider 501, to the key pin 103. The key pin 103 transmits force to the key 1, which enables the surfaces of the key 1 defining the first retaining recess 101 to oppose the biasing force of the spring 402 of the key retainer 4 and push the retaining ball 401 back into the retainer slot 403.

When the retaining ball 401 is fully pushed back into the retainer slot 403, as shown in FIG. 2, the key 1 may longitudinally translate or slide within the key rail 8. If the key assembly 100 includes the spring 6, then the spring pushes the key 1 along the key rail 8. If the key assembly does not include the spring 6, then the user pushes the key 1 along the key rail via the lateral slider 504.

It should be appreciated that the lateral slider 504 is configured to remain motionless when the key 1 is in the longitudinally retracted and extended positions. More specifically, because the lateral slider 504 includes a plurality of rail extensions 503, the plurality of rail extensions 503 prevent the slider 5 from pivoting about the key pin 103 when the key 1 is motionless. To achieve this effect, two or more longitudinally displaced rail extensions (e.g., 503*b* and 503*d*, or 503*a* and 503*c*, or 503*b* and 503*c*) are needed.

As described above, once the key 1 overcomes the key retainer 4, the key 1 longitudinally translates or slides through the key rail 8. During this time, the key pin 103 moves up and down in the pin void 505. When the key 1 reaches its fully extended position, the spring 402 of the retainer 4 pushes the retaining ball 401 into the second retaining recess 102. If the second retaining recess 102 is dome-shaped, then the key 1 is prevented (or substantially prevented) from sliding longitudinally forward and backward until the retaining ball 401 has been pushed back into the retainer slot 403. If the second retaining recess 102 is slanted, as shown in FIG. 3, then the retaining ball 401 prevents the key 1 from longitudinally retracting (i.e., sliding backward). In embodiments where the second retaining recess 102 is slanted, then the front surface 705 of the slider rail 7 is sized and dimensioned such that the forward rail extensions 503*c* and 503*d* abut against the front surface 705 when the key 1 is fully extended.

The invention claimed is:

1. A key assembly comprising:

a key:

defining a retaining recess, being slideably received in a key rail, having a key pin;

a slider:

with extensions, defining a pin void receiving the key pin, being configured to both pivot and translate with respect to the key pin;

a curved slider rail slideably accommodating the extensions.

2. The assembly of claim 1, including a retainer configured to occupy the retaining recess to hold the key in a retracted position.

3. The assembly of claim 2, wherein the retainer includes a retaining ball biased by a spring received in a retainer slot intersecting the key rail.

4. The assembly of claim 1, wherein the retaining recess includes a first retaining recess and a second retaining recess.

5. The assembly of claim 4, wherein the first retaining recess is configured to interface with a retainer to hold the key in a retracted position.

6. The assembly of claim 5, wherein the second retaining recess is configured to interface with the retainer to hold the key in an extended position.

7. The assembly of claim 1, wherein the extensions include at least two longitudinally displaced extensions.

8. The assembly of claim 7, wherein the extensions are configured to fully occupy a height dimension of the slider rail.

9. The assembly of claim 8, wherein the slider rail has a constant height dimension along the curve.

10. The assembly of claim 7, wherein the longitudinal direction is defined to be in a sliding direction of the key within the key rail.

11. The assembly of claim 1, wherein the pin void is a closed void.

12. The assembly of claim 11, wherein the pin void is rectangular.

13. The assembly of claim 1, wherein the key pin is configured to fully occupy a width dimension of the pin void.

14. The assembly of claim 1, wherein the slider partially protrudes from a housing of the key assembly.

15. The assembly of claim 1 including a door disposed at a longitudinal end of the key rail.

16. The assembly of claim 15, wherein a door spring biases the door to a closed position.

17. The assembly of claim 1, wherein the key has a thin portion and a thick portion.

18. The assembly of claim 17, wherein the thick portion of the key is configured to fully occupy a height dimension of the key rail.

19. The key assembly of claim 5, including a housing defining the key rail and the curved slider rail, wherein in the retracted position, the key does not protrude from the housing.

20. A key assembly comprising:

a key defining a retaining recess, being slideably received in a key rail, and having a key pin;

a slider with extensions, defining a pin void receiving the key pin, and being configured to both pivot and translate with respect to the key pin;

a curved slider rail slideably accommodating the extensions;

a retainer configured to occupy the retaining recess to hold the key in a retracted position, the retainer including a retaining ball biased by a spring received in a retainer slot intersecting the key rail;

wherein the retaining recess of the key includes a first retaining recess and a second retaining recess, the first retaining recess is positioned and configured to interface with the retainer to hold the key in the retracted position, the second retaining recess is positioned and configured to interface with the same retainer to hold the key in an extended position;

wherein the extensions include at least two longitudinally displaced extensions each configured to fully occupy a height dimension of the slider rail, wherein the longitudinal direction is defined to be in a sliding direction of the key within the key rail;

wherein the pin void is a generally rectangular closed void and the key pin is sized and configured to fully occupy a width dimension of the pin void, the width dimension of the pin void being parallel to the longitudinal direction.

* * * * *